United States Patent [19]

Shwayder

[11] 4,346,528

[45] Aug. 31, 1982

[54] SKID SHOE FOR SNOW PLOW BLADE

[76] Inventor: Warren M. Shwayder, 2335 E. Lincoln, Birmingham, Mich. 48008

[21] Appl. No.: 206,801

[22] Filed: Nov. 14, 1980

[51] Int. Cl.[3] ..... E01H 5/06

[52] U.S. Cl. ..... 37/270

[58] Field of Search ..... 37/41, 42 R, 42 VL, 37/50; 172/719, 832; 280/28

[56] References Cited

U.S. PATENT DOCUMENTS

| | | | |
|---|---|---|---|
| 1,037,956 | 9/1912 | Miller | 37/41 |
| 2,061,585 | 11/1936 | Meyer | 37/42 R |
| 2,202,309 | 5/1940 | Campbell | 280/28 |
| 3,463,523 | 8/1969 | Vacas | 172/719 X |
| 3,604,517 | 9/1971 | Clifford | 37/42 X |
| 3,732,939 | 5/1973 | Samson | 280/28 |
| 3,845,577 | 11/1974 | Naymik | 37/42 VL |
| 3,934,654 | 1/1976 | Stephenson | 37/42 R X |
| 4,125,950 | 11/1978 | Mashford | 37/41 |
| 4,141,160 | 2/1979 | Olson | 172/719 X |
| 4,261,115 | 4/1981 | Chittenden | 37/42 VL |

FOREIGN PATENT DOCUMENTS

| | | | |
|---|---|---|---|
| 167314 | 5/1950 | Austria | 37/42 R |
| 960035 | 12/1974 | Canada | 37/41 |
| 969357 | 6/1975 | Canada | 37/41 |

*Primary Examiner*—E. H. Eickholt

*Attorney, Agent, or Firm*—Cullen, Sloman, Cantor, Grauer, Scott & Rutherford

[57] ABSTRACT

A skid shoe for a snow plow blade is attached to the plow moldboard at the pre-existing bolt holes used to fasten the blade to the moldboard such that the shoe is mounted close to the cutting edge of the blade. Hard carbide wear bars or strips are fastened to the skid shoe for reducing the abrasive action on the cutting edge of the blade thereby prolonging the life of the blade. Each wear bar consists of a steel envelope packed with a carbide-bronze matrix. The wear bars are weldable to the skid shoe and easily replaced by welding a new bar on the top of an old one or by welding a new bar directly to the skid shoe. The steel envelope works to hold the carbide-bronze matrix together, and the ductile bronze gives the hard carbide additional durability and shock absorption, which means longer shoe life with less blade wear.

6 Claims, 8 Drawing Figures

SKID SHOE FOR SNOW PLOW BLADE

BACKGROUND OF THE INVENTION

The present invention relates to a skid shoe for a snow plow blade, and more particularly, to a shoe which is bolted to the plow moldboard at the pre-existing bolt holes used to fasten the blade to the moldboard. Further, the skid shoe includes wear bars made of a carbide-bronze matrix packed within a steel jacket.

The blade on typical snow removing machines is subjected to extensive vibration, impact, and abrasive action, resulting from the scraping action between the cutting edge of the blade and the roadbed over which the machine travels. As a result, the blade edge wears and chips due to the road abrasion and impact and must be replaced every few hours. This is a costly proposition because of the down time of the machine and cost expended in manpower and materials to make a blade changeover.

It is conventional to provide caster-like wheels or wear shoes which are attached to, but spaced from, the plow moldboard for the purpose of supporting part of the load on the blade. These known prior art devices are relatively bulky, expensive to manufacture, and difficult to install on the snow plow. The caster-like wheels frequently jam or flatten and are expensive to maintain and replace. Further, these known devices require regular adjustment, lubrication, and permit debris and the like to lodge or jam between their supporting structure and the moldboard.

Thus, there has been a need for an improved means which supports the cutting edge of a snow plow blade from the roadbed for reducing or dampening the undesirable vibrating, impact and abrasive action on the blade. The disadvantages of present wheel and wear shoe constructions have resulted in the improved skid shoe-wear bar combination of the present invention which effectively reduces blade wear resulting from road abrasion.

SUMMARY OF THE INVENTION

The present invention includes a plate-like skid shoe or bracket which is secured to the plow moldboard at the pre-existing bolt holes used to fasten the blade to the moldboard such that the shoe is mounted close to the cutting edge of the blade. A number of hard carbide wear bars are fastened to the bracket for reducing the abrasive action on the blade edge from the roadbed. Each wear bar consists of a steel jacket packed with a carbide-bronze matrix where the steel jacket permits the bars to be easily welded to the skid shoe. The wear bars of the present invention are easily replaced by welding a new bar on the top of an old one or by welding a new bar directly to the skid shoe. Further, the wear bar steel jacket works to hold the carbide-bronze matrix together, and the ductile bronze provides the hard carbide additional durability and shock absorption.

The present construction eliminates prior complicated and bulky supporting structure, thereby reducing the time and cost of fitting the skid shoe and wear bars onto the snow plow. Additionally, the bolts used for mounting the blade and skid shoe to the moldboard become shock and impact absorbers for the cutting edge of the blade.

The skid shoe includes a mounting plate and U-shaped bracket having a generally horizontal skid surface wherein the bracket is welded or otherwise secured to the mounting plate. The wear bars or strips are secured to the generally horizontal bracket surface in an inclned arrangement to more evenly distribute the abrasive loads from the roadbed across the wear bars. The wear bars partially support the cutting edge of the blade such that the abrasive action and impact from the roadbed works on the bars instead of the blade cutting edge, thereby substantially prolonging the life of the blade. Further, since the wear bars are mounted close to the blade cutting edge, they are better able to absorb the abrasive action and impact imposed on the blade.

The bolt mounting openings for standard snow plow blades are typically on 8-inch or 12-inch centers. The mounting plate for the skid shoe includes two sets of spaced apart mounting openings such that the skid shoe may be mounted to a blade having either 8-inch bolt hole centers or 12-inch centers. Other standard mounting hole spacings are also within the scope of the present invention.

As described, each wear bar includes carbide particles embedded in bronze with the bronze-carbide matrix encased in a steel jacket or envelope. The ductile bronze gives the hard carbide particles additional durability and provides shock-absorption, which means longer shoe life with less blade wear. The present wear bars are intended to perform better than solid carbide bars would under the extreme conditions of vibration, impact and thermal shock experienced by snow plow blades. While bronze is preferred as the matrix component, other pure metals or alloys are within the scope of the present invention.

When the roadbed engaging side of the steel casing is worn away by abrasion, the exposed carbide-bronze matrix becomes the wear surface. The carbide particles do not chip or break off as readily as they would in a solid block of carbide because they are embedded in the bronze which provides both shock-absorption to the particles and gripping action on them. That is, the bronze mechanically bonds the carbide particles to each other and to the steel cladding making a solid piece construction.

The wearing qualities of the bronze-carbide matrix is further enhanced by the retaining side walls of the steel jacket which set up compressive forces to hold the matrix intact. The steel casing also permits the wear bars to be easily installed and replaced on the U-shaped bracket by welding. A new bar may be welded on the top of an old one or welded directly to the skid shoe bracket.

The wear bars are mounted to the horizontal bracket surface such that they are inclined to the axis of the blade instead of being perpendicular to it. This spatial relationship of the wear bars more evenly distributes the abrasive loads from the roadbed across the wear bars and reduces the possibility of direct contact between the ends of the bars and roadbed which would tend to gouge or tear the bars.

A further advantage of the present skid shoe construction resides in the mounting of the shoe close to the blade cutting edge. As compared to prior constructions which are spaced from the blade on independent supporting structure, the present skid shoe is substantially an integral part of the blade and, therefore, capable of absorbing more of the undesirable abrasive wear.

Other advantages and meritorious features of the skid shoe-wear bar combination of the present invention will be more fully understood from the following description of the preferred embodiment, the appended claims, and the drawings, a brief description of which follows.

DETAILED DESCRIPTION OF THE INVENTION

Figure 1:
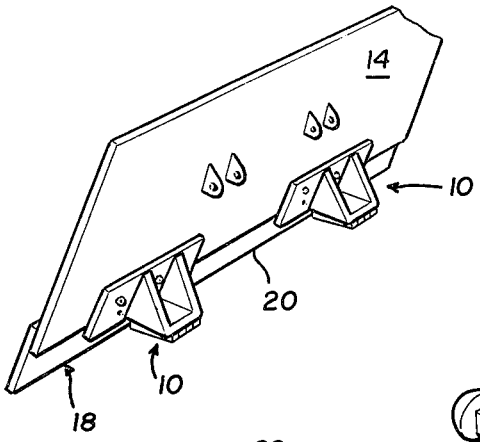
FIG. 1 is a perspective view of a snow plow blade equipped with the skid shoe-wear bar combination of the present invention.
Figure 2:
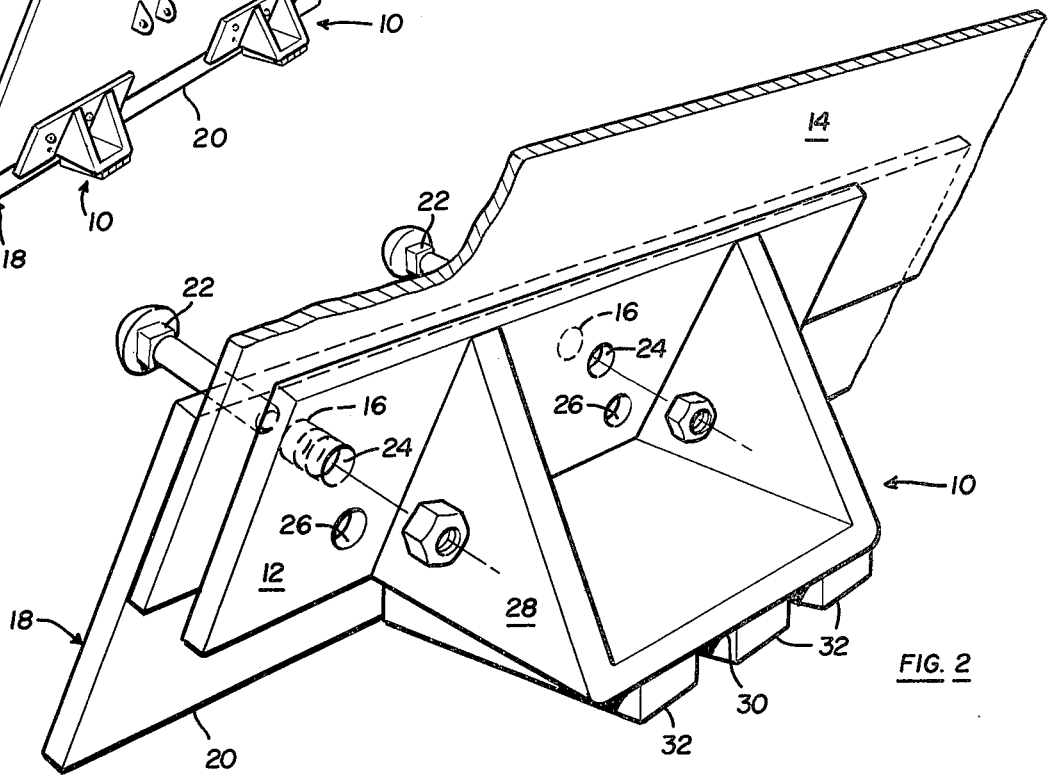
FIG. 2 is an enlarged perspective view of the skid shoe of the present invention.

A preferred embodiment of the skid-wear bar combination made in accordance with the teachings of the present invention is illustrated in FIGS. 1–6. The skid shoe 10 is used to reduce the extensive vibration, impact, and abrasive action between the cutting edge of a snow plow blade and the roadbed over which the snow plow travels. Typically, a pair of skid shoes 10 are mounted on opposite ends of the blade, as illustrated in FIG. 1.

The skid shoe 10 of the present invention includes a mounting plate 12 which is secured to the backside of a conventional snow plow moldboard 14 at the pre-existing bolt holes 16 used to fasten the blade 18 and moldboard 14 such that shoe 10 is mounted close to the cutting edge 20 of blade 18. One of the advantages of the skid shoe 10 is that it is mounted to moldboard 14 using longer bolts 22 and the same bolt openings 16 which are used in securing blade 18 to moldboard 14. Thus, the present construction eliminates prior complicated and bulky supporting structure for the skid shoe, thereby reducing the time and cost of fitting the skid shoe 10 onto the snow plow. Further, the bolts 22 for mounting blade 18 and skid shoe 10 to moldboard 14 become shock and impact absorbers for the cutting edge 20 of blade 18.

The bolt mounting openings 16 for snow plow blade 18 are located along moldboard 14 at standard spacings of 8-inch or 12-inch centers. Mounting plate 12 includes two sets of spaced apart mounting openings 24 and 26, respectively, such that skid shoe 10 may be mounted to a blade 18 having either 8-inch bolt hole centers or 12-inch centers. Other standard mounting hole spacings are also within the scope of the present invention.

The skid shoe 10 further includes a U-shaped bracket 28 having a generally horizontal skid surface 30 wherein the bracket is welded or otherwise secured to the mounting plate 12. A plurality of wear bars 32 are secured to the generally horizontal bracket surface 30 in an inclined arrangement for a purpose as will be described. The wear bars 32 support the cutting edge 20 of the blade such that the abrasive action and impact from the roadbed works on the bars instead of the blade cutting edge, thereby substantially prolonging the life of the blade. Further, since the wear bars 32 are mounted close to the blade cutting edge 20, they are better able to absorb the abrasive action and impact imposed on the blade.

Figure 4:
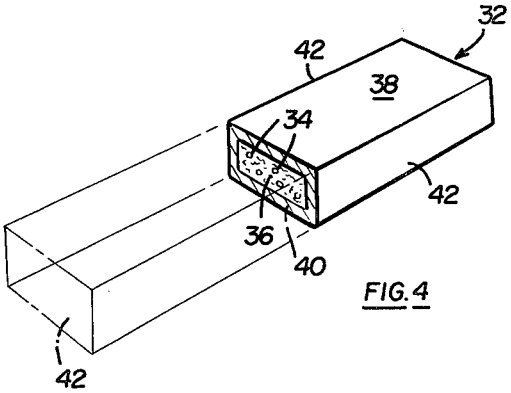
FIG. 4 is a perspective view, partially in cross-section, illustrating an individual wear bar of the present invention.
Figure 3:
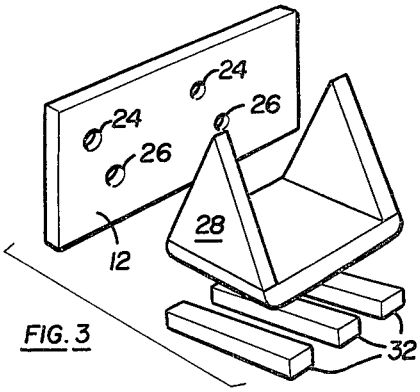
FIG. 3 is an assembly perspective illustrating the individual components of the skid shoe.

Referring to FIG. 4, each wear bar 32 includes carbide particles 34 embedded in bronze 36 with the bronze-carbide matrix encased in a steel jacket or envelope 38. The ductile bronze 36 gives the hard carbide particles 34 additional durability and provides shock absorption, which means longer shoe life with less blade wear. While bronze is preferred as the matrix component, other pure metals or alloys are within the scope of the present invention.

Figure 6A:
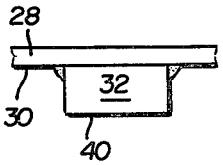
FIG. 6*a* is a detail view of a new wear bar welded to the skid shoe bracket.
Figure 6B:
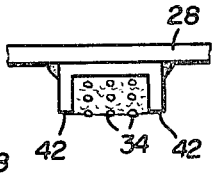
FIG. 6*b* is a detail view of a wear bar with the roadbed engaging side of the steel casing worn away by abrasion.

When the roadbed-engaging side 40 of steel casing 38 is worn away by abrasion, the exposed carbide-bronze matrix 34, 36 becomes the wear surface, as illustrated in FIG. 6*b*. The carbide particles 34 do not chip or break off as readily as they would in a solid block of carbide because they are embedded in the bronze 36 which provides both shock-absorption to the particles and gripping action on them. The bronze 36, in effect, mechanically bonds the carbide particles 34 to each other and to the steel cladding 38 making a solid piece construction.

The wearing qualities of the bronze-carbide matrix is further enhanced by the retaining end and side walls 42 of the steel jacket 38 which set up compressive forces to hold the matrix intact. The steel casing 38 also permits the wear bars 32 to be easily installed and replaced on bracket 28 by welding.

Figure 6C:
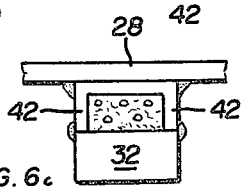
FIG. 6*c* is a detail view of a new wear bar welded to the top of an old wear bar.

The wear bars 32 may be easily fastened to bracket 28 by directly welding a new bar to the bracket as illustrated in FIG. 6*a*. Alternatively, a new bar 32 may be welded on the top of an old one, as illustrated in FIG. 6*c*.

Figure 5:
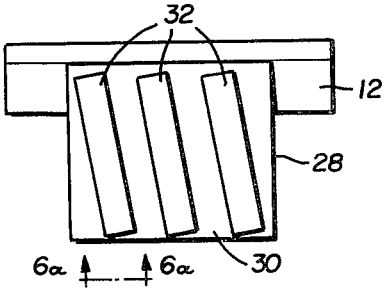
FIG. 5 is a bottom view of the skid shoe illustrating the inclined spatial relationship between the wear bars.

Referring to FIG. 5, the wear bars 32 are mounted to the horizontal bracket surface 30 such that they are inclined to the axis of blade 18 instead of being perpendicular to it. This spatial relationship of the wear bars more evenly distributes the abrasive load from the roadbed across the wear bars and reduces the possibility of direct contact between the ends of the bars and roadbed which would tend to gouge or tear the bars.

A further advantage of the skid shoe 10 resides in the mounting of the shoe close to the blade cutting edge 20. As compared to prior constructions which are spaced from the blade on independent supporting structure, the present skid shoe 10 is a more integral part of the blade and, therefore, capable of absorbing more of the undesirable abrasive wear.

It will be apparent to those skilled in the art that the foregoing disclosure is exemplary in nature, rather than limiting, the invention being limited only by the appended claims.

I claim:

1. A skid shoe for a snow plow blade, said shoe being attached to the moldboard of said plow at the pre-existing bolt holes used to fasten said blade to said moldboard such that said shoe is mounted close to the cutting edge of said blade, said skid shoe including a bracket, and a plurality of weldable hard carbide wear bars mounted to said bracket for engaging a roadbed and for supporting the cutting edge of said blade such that the abrasive action on said blade from the roadbed is reduced by said wear bars;

and wherein each wear bar includes a matrix of carbide particles and ductile bronze packed in a weldable steel jacket, said ductile bronze providing substantial durability and shock-absorption to said particles, and said wear bars being weldable to said bracket and easily replaced by welding a new bar on the top of an old one or by welding a new bar directly to said bracket.

2. The skid shoe as defined in claim 1, wherein said steel jacket includes opposed side and end walls which compress said carbide-bronze matrix to hold said matrix intact during abrasive action on said wear bar from said roadbed.

3. The skid shoe as defined in claim 1, wherein said wear bars are mounted to said bracket such that their axes are inclined to the axis of the blade cutting edge wherein the abrasive action from the roadbed is more evenly distributed across the wear bars.

4. A skid shoe for a plow including a moldboard with a blade having a lower blade edge, with said shoe being attached to the moldboard close to said edge, said skid shoe including a bracket, and a weldable hard carbide wear bar mounted upon said bracket, said bar having a lower wear surface aligned with said edge for engaging in fact to face contact against a road-like surface simultaneously with and in horizontal alignment with the blade edge, while the blade edge is contacting the road-like surface, for supporting the blade edge and thereby reducing the abrasive action on said blade edge;

and wherein said wear bar includes a matrix of hard carbide particles and ductile surrounding material arranged within a weldable steel container, with said ductile material providing for substantial shock-absorption, and said wear bar being weldable to said bracket.

5. The skid shoe as defined in claim 4 wherein said wear bar is mounted to said bracket with its axes inclined at an angle relative to the axis of the blade edge wherein the abrasive action from the road-like surface is more evenly distributed across the wear bar.

6. The skid shoe as defined in claim 4 wherein said skid shoe bracket includes an upright mounting plate which is secured to the backside of said moldboard by bolts extending through pre-existing bolt holes formed in the moldboard for normally bolting the blade to the moldboard, said mounting plate including a plurality of spaced apart pairs of bolt receiving openings for accommodating to various standard spacings between said bolt holes; and wherein the bolts also act as shock and impact absorbers for the shoe and wear bar.

* * * * *